US006516475B1

(12) United States Patent
Anderson

(10) Patent No.: US 6,516,475 B1
(45) Date of Patent: Feb. 11, 2003

(54) TOILET DEVICE

(76) Inventor: Mark W. Anderson, 22-825 Longview, Sky Valley, CA (US) 92241

( * ) Notice: Subject to any disclaimer, the term of this patent is extended or adjusted under 35 U.S.C. 154(b) by 0 days.

(21) Appl. No.: 09/965,721

(22) Filed: Sep. 27, 2001

(51) Int. Cl.[7] ..... E03D 9/08
(52) U.S. Cl. ..... 4/420.4; 4/447
(58) Field of Search ..... 4/420, 905, 443–448, 4/311, 420.4

(56) References Cited

U.S. PATENT DOCUMENTS

| | | | | | |
|---|---|---|---|---|---|
| 1,155,885 | A | * | 10/1915 | Catchings | 4/420 |
| 1,243,148 | A | * | 10/1917 | Erwin | 4/420 |
| D105,006 | S | | 6/1937 | Groeniger | |
| 2,185,887 | A | | 1/1940 | Dennis | |
| D119,871 | S | | 4/1940 | Van Sciver | |
| 2,703,409 | A | * | 3/1955 | Manning et al. | 4/311 |
| 4,882,791 | A | | 11/1989 | Kimes | |
| 4,928,328 | A | | 5/1990 | Davis | |
| D392,726 | S | | 3/1998 | Garza | |

* cited by examiner

*Primary Examiner*—Charles E. Phillips

(57) ABSTRACT

A toilet device for providing a toilet which allows a person in a wheelchair to slide from the wheelchair directly onto the toilet. The toilet device includes a toilet bowl having a seat portion and a peripheral wall extending downwardly from the seat portion. The peripheral wall includes a back side, a front side, and a pair of lateral sides. The back side has a height greater than the front side. The seat portion generally has an L-shape such that the seat portion has a generally horizontal portion and a generally vertical portion. A chamber is defined between an inner surface and an outer surface of the peripheral wall. The inner surface comprises a bowl and a drain. A flushing system is in fluid communication with the toilet bowl. A user wheels a wheelchair to the front side and slides from the wheelchair and onto the seat portion.

11 Claims, 5 Drawing Sheets

TOILET DEVICE

BACKGROUND OF THE INVENTION

1. Field of the Invention

The present invention relates to toilets and more particularly pertains to a new toilet device for providing a toilet which allows a person in a wheelchair to slide from the wheelchair directly onto the toilet.

2. Description of the Prior Art

The use of toilets is known in the prior art. More specifically, toilets heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,882,791; U.S. Pat. No. Des. 4,928,328; U.S. Pat. No. Des. 392,726; U.S. Pat. No. Des. 119,871; U.S. Pat. No. 2,185,887; and U.S. Pat. No. Des. 105,006.

While these devices fulfill their respective, particular objectives and requirements, the aforementioned patents do not disclose a new toilet device. The inventive device includes a toilet bowl having a seat portion and a peripheral wall extending downwardly from the seat portion. The peripheral wall includes a back side, a front side, and a pair of lateral sides. The back side has a height greater than the front side. The seat portion generally has an L-shape such that the seat portion has a generally horizontal portion and a generally vertical portion. The front side is rounded. The peripheral wall has an inner surface and an outer surface. A chamber is defined between the inner surface and the outer surface. The inner surface comprises a bowl and a drain. A flushing system is in fluid communication with the toilet bowl. A user may use the device by wheeling a wheelchair to the front side and sliding from the wheelchair and onto the seat portion such that the user's body is facing toward the back side of the toilet bowl portion.

In these respects, the toilet device according to the present invention substantially departs from the conventional concepts and designs of the prior art, and in so doing provides an apparatus primarily developed for the purpose of providing a toilet which allows a person in a wheelchair to slide from the wheelchair directly onto the toilet.

SUMMARY OF THE INVENTION

In view of the foregoing disadvantages inherent in the known types of toilets now present in the prior art, the present invention provides a new toilet device construction wherein the same can be utilized for providing a toilet which allows a person in a wheelchair to slide from the wheelchair directly onto the toilet.

The general purpose of the present invention, which will be described subsequently in greater detail, is to provide a new toilet device apparatus and method which has many of the advantages of the toilets mentioned heretofore and many novel features that result in a new toilet device which is not anticipated, rendered obvious, suggested, or even implied by any of the prior art toilets, either alone or in any combination thereof.

To attain this, the present invention generally comprises a toilet bowl having a seat portion and a peripheral wall extending downwardly from the seat portion. The peripheral wall includes a back side, a front side, and a pair of lateral sides. The back side has a height greater than the front side. The seat portion generally has an L-shape such that the seat portion has a generally horizontal portion and a generally vertical portion. The front side is rounded. The peripheral wall has an inner surface and an outer surface. A chamber is defined between the inner surface and the outer surface. The inner surface comprises a bowl and a drain. A flushing system is in fluid communication with the toilet bowl. A user may use the device by wheeling a wheelchair to the front side and sliding from the wheelchair and onto the seat portion such that the user's body is facing toward the back side of the toilet bowl portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet device apparatus and method which has many of the advantages of the toilets mentioned heretofore and many novel features that result in a new toilet device which is not anticipated, rendered obvious, suggested, or even implied by any of the prior art toilets, either alone or in any combination thereof.

It is another object of the present invention to provide a new toilet device which may be easily and efficiently manufactured and marketed.

It is a further object of the present invention to provide a new toilet device which is of a durable and reliable construction.

An even further object of the present invention is to provide a new toilet device which is susceptible of a low cost of manufacture with regard to both materials and labor, and which accordingly is then susceptible of low prices of sale to the consuming public, thereby making such toilet device economically available to the buying public.

Still yet another object of the present invention is to provide a new toilet device which provides in the apparatuses and methods of the prior art some of the advantages thereof, while simultaneously overcoming some of the disadvantages normally associated therewith.

Still another object of the present invention is to provide a new toilet device for providing a toilet which allows a person in a wheelchair to slide from the wheelchair directly onto the toilet.

Yet another object of the present invention is to provide a new toilet device which includes a toilet bowl having a seat portion and a peripheral wall extending downwardly from the seat portion. The peripheral wall includes a back side, a front side, and a pair of lateral sides. The back side has a height greater than the front side. The seat portion generally has an L-shape such that the seat portion has a generally horizontal portion and a generally vertical portion. The front side is rounded. The peripheral wall has an inner surface and an outer surface. A chamber is defined between the inner surface and the outer surface. The inner surface comprises a bowl and a drain. A flushing system is in fluid communication with the toilet bowl. A user may use the device by wheeling a wheelchair to the front side and sliding from the wheelchair and onto the seat portion such that the user's body is facing toward the back side of the toilet bowl portion.

Still yet another object of the present invention is to provide a new toilet device that has a height generally equal to the height of a wheelchair seat for easy transferring from one to the other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
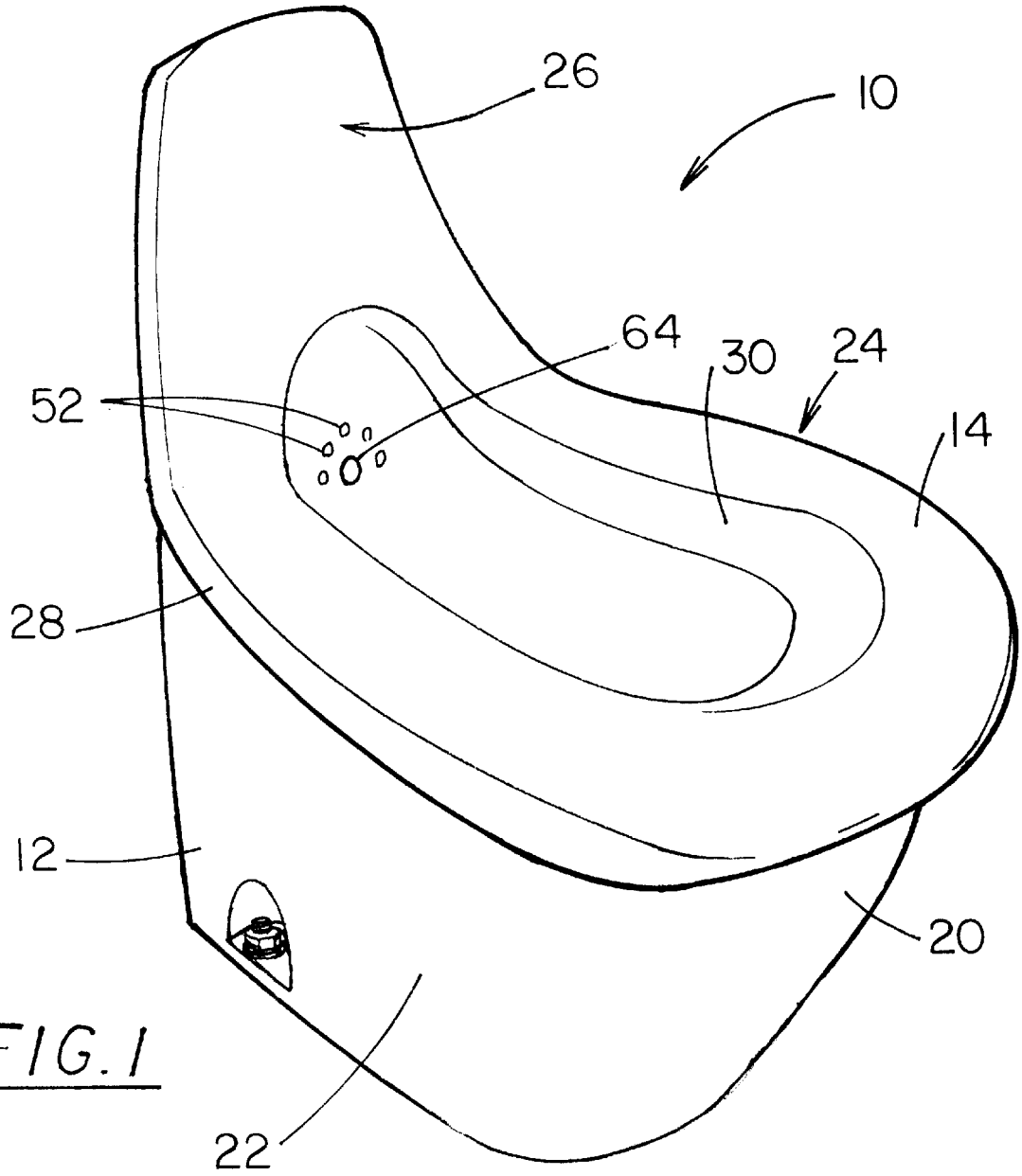
FIG. 1 is a schematic perspective view of a new toilet device according to the present invention.
Figure 2:
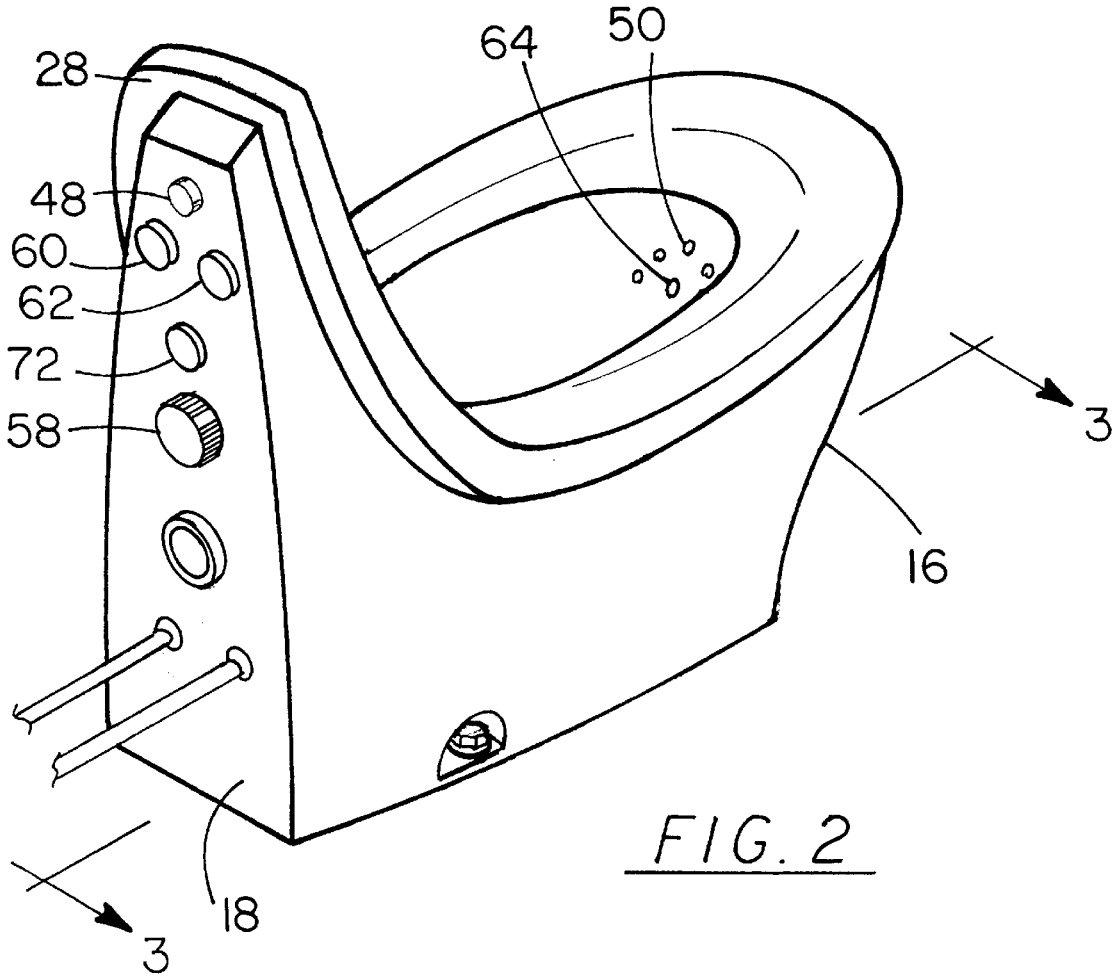
FIG. 2 is a schematic perspective view of the present invention.
Figure 3A:
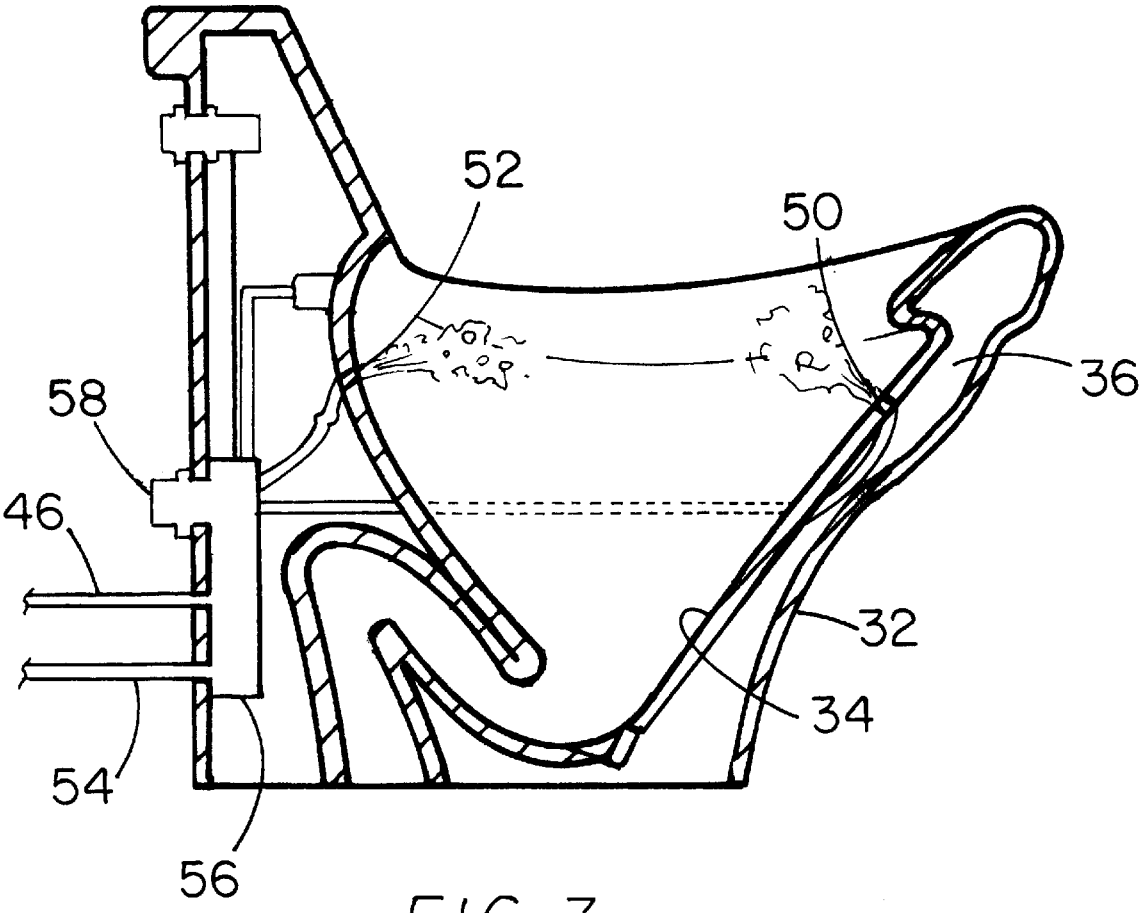
FIG. 3*a* is a schematic cross-sectional view of the rinsing system of the present invention.
Figure 3B:
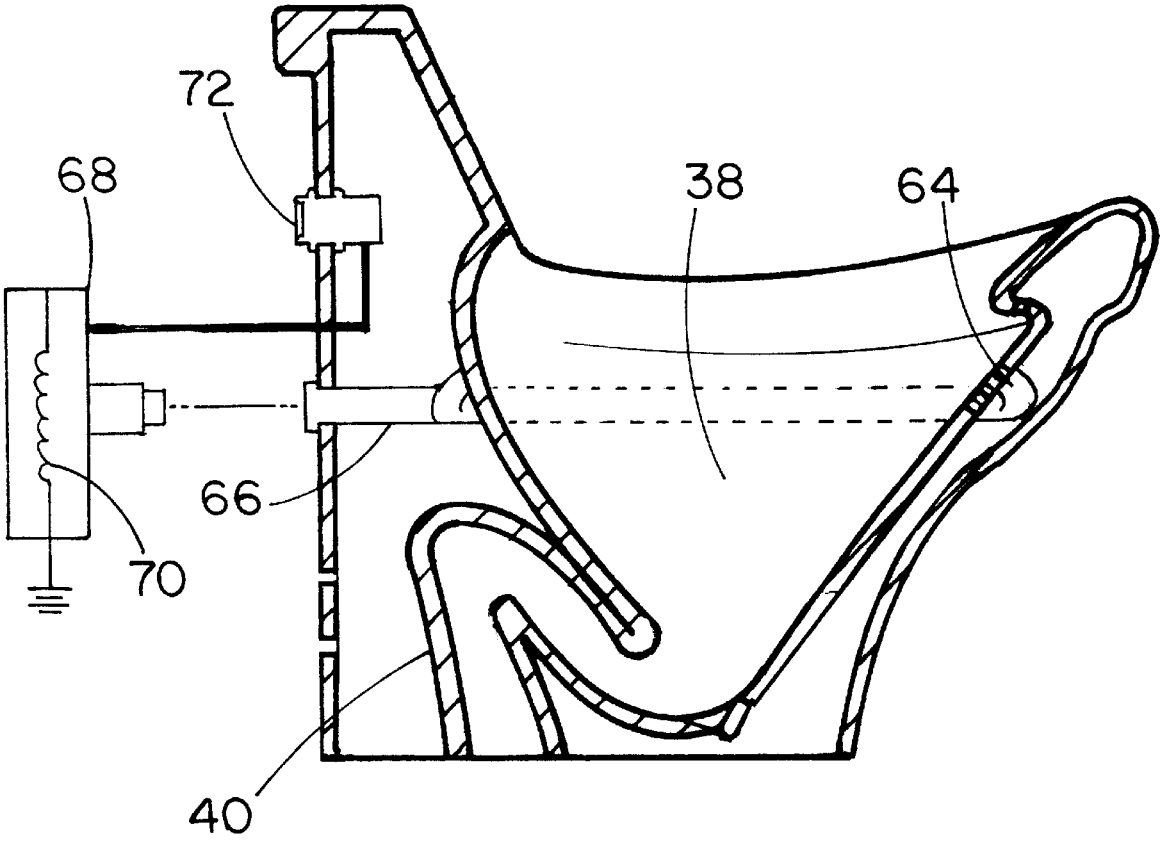
FIG. 3*b* is a schematic cross-sectional view drying system of the present invention.
Figure 3C:
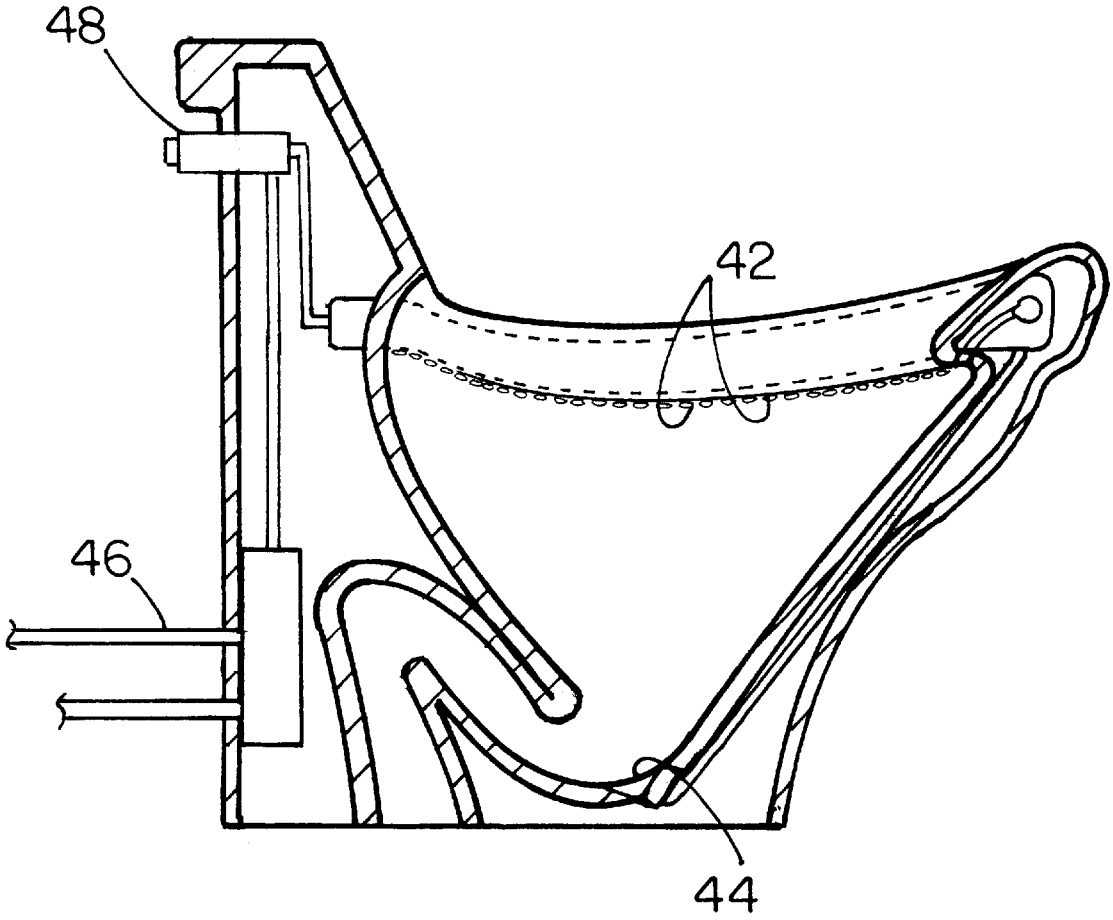
FIG. 3*c* is a schematic cross-sectional view of the flushing system of the present invention.

With reference now to the drawings, and in particular to FIGS. 1 through 3 thereof, a new toilet device embodying the principles and concepts of the present invention and generally designated by the reference numeral 10 will be described.

As best illustrated in FIGS. 1 through 3, the toilet device 10 generally comprises a toilet bowl 12 having a seat portion 14 and a peripheral wall 16 extending downwardly from the seat portion 14. The peripheral wall 16 includes a back side 18, a front side 20, and a pair of lateral sides 22. The back side 18 has a height greater than the front side 20. The seat portion 14 generally has an L-shape such that the seat portion 14 has a generally horizontal portion 24 and a generally vertical portion 26. The seat portion 14 is arced at a juncture of the horizontal portion 24 and the vertical portion 26. The seat portion 14 has an outer lip 28 and an inner lip 30. The outer 28 and inner 30 lips are rounded. The outer lip 28 aids the user as a handgrip adjacent to the back side 18 and the rounded nature of the lips prevents pinching of the skin as a person slides onto the seat portion. The front side 20 is rounded. The peripheral wall 16 has an inner surface 32 and an outer surface 34. A chamber 36 is defined between the inner surface 32 and the outer surface 34. The inner surface 32 comprises a bowl 38 and a conventional drain 40 used for toilets. The bowl 38 is relatively deep with respect to conventional toilets and extends downward to a point adjacent generally adjacent to a bottom of the toilet bowl 12. The front side 20 has a height generally between 18 inches and 24 inches. The front side 20 tapers toward the back side 18 as the front side 20 extends downward in order to allow a wheelchair to move very close to the toilet bowl 12.

A flushing system is in fluid communication with the toilet bowl 12. The flushing system is conventional flushing system for a toilet. An example of the flushing system includes the inner surface 34 having a plurality of apertures 42 therein extending into the chamber 36 and extending around the bowl 38 and positioned adjacent to the seat portion 14. A bore 44 extends through inner surface 34 and into the chamber 36. The bore 44 is positioned in a bottom portion of the bowl 38. The bore defines an outlet directed from the chamber 36 and generally toward the drain 40 for forcing additional water into the drain 40 for urging solid waste into and through the drain 40. A first inlet pipe 46 extends through the back side 18 and into the chamber 36. The first inlet pipe 46 is fluidly coupled to the apertures 42 and the bore 44. A first valve 48 is in communication with the first inlet pipe 46 for selectively allowing water flow through the apertures 42 and the bore 44. The first valve 48 is mounted on the back side 18.

A rinsing system is in fluid communication with the toilet bowl 12. The rinsing system includes the inner surface 34 having a pair of sets of openings 50 ,52 therein and extending into the chamber 36. A first 50 of the sets of openings is positioned in the front side 20 and a second 52 of the sets of openings is positioned in the back side 18. A second inlet pipe 54 extends through the back side 18 and into the chamber 36. The first 50 and second 52 inlet pipes are in fluid communication with each of the openings 50, 52. The first inlet pipe 46 defines a cold water supply and the second inlet pipe 54 defines a warm water supply. A valve assembly 56 is in communication with the first 46 and second 54 inlet pipes for selectively allowing water flow through the openings 50, 52. The valve assembly 56 includes a water temperature control means 58 mounted on the back side for selectively mixing water and adjusting the ratio from each of the first 46 and second 54 inlet pipes. A first actuator 60 is operationally coupled to the valve assembly for turning water flow on or off through the first set of openings 50 and a second actuator 62 is operationally coupled to the valve assembly 56 for turning water flow on or off through the second set of openings 52. The first 60 and second 62 actuators are mounted on the back side 18. Envisioned are motion detectors being used for the first and second actuators to aid in the use of the device. Ideally, the use of the first 50 and second 52 actuators also activates the flushing system such that the device is flushed at the same time the user rinses. This combination is shown in FIG. 3*a* which omits the first valve 48.

A drying system for drying a user includes the inner surface having a pair of holes 64 extending therethrough and into the chamber 36. Each of the holes 64 is positioned generally adjacent to one of the sets 50, 52 of the openings. An inlet duct 66 extends through the back side 18 and into the chamber 36. The inlet duct 66 is in communication with the holes 64. A blowing means 68 for blowing air is in communication with the inlet duct 66. The blowing means 68 includes a heating means 70 for heating air blown in to the inlet duct 66 by the blowing means 68. A switch 72 for selectively tuning the blowing means 68 on or off is operationally coupled to the blowing means 68 and positioned on the back side 18. The blowing and heating means are conventional hand drying type blowing and heating means.

In use, a user wheels their wheelchair to the front side 20 and slides from the wheelchair and onto the seat portion 14 such that the user's body is facing toward the back side 18 of the toilet bowl 12. In this position, the user is straddling the toilet and may user the outer lip 28 as a handle. The user uses the actuators and first valve in order to select the activity of the device. When finished, the user slides back onto their wheelchair. This allows the user to use the device without having to turn their wheelchair away from the toilet and lift themselves onto the toilet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet device for handicapped persons, said device comprising:

a toilet bowl having a seat portion and a peripheral wall extending downwardly from said seat portion, said peripheral wall including a back side, a front side, and a pair of lateral sides, said back side having a height greater than said front side, said seat portion generally having an L-shape such that said seat portion has a generally horizontal portion and a generally vertical portion, said front side being rounded, said peripheral wall having an inner surface and an outer surface, a chamber being defined between said inner surface and said outer surface, said inner surface comprising a bowl and a drain;

a flushing system being in fluid communication with said toilet bowl;

wherein a user may use said device by wheeling a wheelchair to the front side and sliding from the wheelchair and onto the seat portion such that the user's body is facing toward the back side of the toilet bowl portion; and wherein said flushing system includes said inner surface having a plurality of apertures therein extending into said chamber, said apertures extending around said bowl and being positioned adjacent to said seat portion, a bore extending through said inner surface and into said chamber, said bore being positioned in a bottom portion of said bowl, said bore defining an outlet directed from said chamber and generally toward said drain, a first inlet pipe extending through said back side and into said chamber, said first inlet pipe being fluidly coupled to said apertures and said bore, a first valve being in communication with said first inlet pipe for selectively allowing water flow through said apertures and said bore, said first valve being mounted on said back side.

2. The toilet and bidet combination device as in claim 1, wherein said seat portion is arced at a juncture of said horizontal portion and said vertical portion.

3. The toilet and bidet combination device as in claim 1, wherein said seat portion has an outer lip and an inner lip, said outer and inner lips being rounded.

4. The toilet and bidet combination device as in claim 3, wherein said front side has a height generally between 18 inches and 24 inches.

5. The toilet and bidet combination device as in claim 3, wherein said front side tapers toward said back side as said front side extends downward.

6. The toilet and bidet combination device as in claim 1, wherein said front side tapers toward said back side as said front side extends downward.

7. A toilet device for handicapped persons, said device comprising:

a toilet bowl having a seat portion and a peripheral wall extending downwardly from said seat portion, said peripheral wall including a back side, a front side, and a pair of lateral sides, said back side having a height greater than said front side, said seat portion generally having an L-shape such that said seat portion has a generally horizontal portion and a generally vertical portion, said front side being rounded, said peripheral wall having an inner surface and an outer surface, a chamber being defined between said inner surface and said outer surface, said inner surface comprising a bowl and a drain;

a flushing system being in fluid communication with said toilet bowl;

a rinsing system being in fluid communication with said toilet bowl;

wherein a user may use said device by wheeling a wheelchair to the front side and sliding from the wheelchair and onto the seat portion such that the user's body is facing toward the back side of the toilet bowl portion; and wherein said rinsing system includes said inner surface having a pair of sets of openings therein and extending into said chamber, a first of said sets of openings being positioned in said front side and a second of said sets of openings being positioned in said back side, a first inlet pipe and a second inlet pipe extending through said back side and into said chamber, said first and second inlet pipes being in fluid communication with each of said openings, wherein said first inlet pipe defines a cold water supply and said second inlet pipe defines a warm water supply.

8. The toilet and bidet combination device as in claim 7, a valve assembly being in communication with said first and second inlets pipes for selectively allowing water flow through said openings, said valve assembly including a water temperature control means mounted on said back side for selectively mixing water from each of said first and second inlet pipes.

9. The toilet and bidet combination device as in claim 8, a first actuator being operationally coupled to said valve assembly for turning water flow on or off through said first set of openings, a second actuator being operationally coupled to said valve assembly for turning water flow on or off through said second set of openings, said first and second actuators being mounted on said back side.

10. The toilet and bidet combination device as in claim 8, further including a drying system for drying a user including a said inner surface having a pair of holes extending therethrough and into said chamber, each of said holes being positioned generally adjacent to one of said sets of said openings, an inlet duct extending through said back side and into said chamber, said inlet duct being in communication with said holes, a blowing means for blowing air being in communication with said inlet duct, said blowing means including a heating means for heating air blown into said inlet duct by said blowing means, a switch for selectively tuning said blowing means on or off being operationally coupled to said blowing means and positioned on said back side.

11. A toilet and bidet combination device for handicapped persons, said device comprising:

a toilet bowl having a seat portion and a peripheral wall extending downwardly from said seat portion, said peripheral wall including a back side, a front side, and a pair of lateral sides, said back side having a height greater than said front side, said seat portion generally having an L-shape such that said seat portion has a generally horizontal portion and a generally vertical portion, said seat portion being arced at a juncture of said horizontal portion and said vertical portion, said seat portion having an outer lip and an inner lip, said outer and inner lips being rounded, said front side being rounded, said peripheral wall having an inner surface and an outer surface, a chamber being defined between said inner surface and said outer surface, said inner surface comprising a bowl and a drain, said front side having a height generally between 18 inches and 24 inches, said front side tapering toward said back side as said front side extends downward;

a flushing system being in fluid communication with said toilet bowl, said flushing system including said inner surface having a plurality of apertures therein extending into said chamber, said apertures extending around said bowl and being positioned adjacent to said seat portion, a bore extending through inner surface and into said chamber, said bore being positioned in a bottom portion of said bowl, said bore defining an outlet directed from said chamber and generally toward said drain, a first inlet pipe extending through said back side and into said chamber, said first inlet pipe being fluidly coupled to said apertures and said bore, a first valve being in communication with said first inlet pipe for selectively allowing water flow through said apertures and said bore, said first valve being mounted on said back side;

a rinsing system being in fluid communication with said toilet bowl, said rinsing system including said inner surface having a pair of sets of openings therein and extending into said chamber, a first of said sets of openings being positioned in said front side and a second of said sets of openings being positioned in said back side, a second inlet pipe extending through said back side and into said chamber, said first and second inlet pipes being in fluid communication with each of said openings, wherein said first inlet pipe defines a cold water supply and said second inlet pipe defines a warm water supply, a valve assembly being in communication with said first and second inlets pipes for selectively allowing water flow through said openings, said valve assembly including a water temperature control means mounted on said back side for selectively mixing water from each of said first and second inlet pipes, a first actuator being operationally coupled to said valve assembly for turning water flow on or off through said first set of openings, a second actuator being operationally coupled to said valve assembly for turning water flow on or off through said second set of openings, said first and second actuators being mounted on said back side;

a drying system for drying a user including a said inner surface having a pair of holes extending therethrough and into said chamber, each of said holes being positioned generally adjacent to one of said sets of said openings, an inlet duct extending through said back side and into said chamber, said inlet duct being in communication with said holes, a blowing means for blowing air being in communication with said inlet duct, said blowing means including a heating means for heating air blown into said inlet duct by said blowing means, a switch for selectively tuning said blowing means on or off being operationally coupled to said blowing means and positioned on said back side; and wherein a user may use said device by wheeling a wheelchair to the front side and sliding from the wheelchair and onto the seat portion such that the user's body is facing toward the back side of the toilet bowl portion.

* * * * *